US006325210B1

(12) United States Patent
Henry, Jr.

(10) Patent No.: US 6,325,210 B1
(45) Date of Patent: Dec. 4, 2001

(54) WINE BOTTLE PACKAGE

(76) Inventor: Douglass C. Henry, Jr., Old Mill Rd., R.D. #1, Box 415, Newmanstown, PA (US) 17073

( * ) Notice: Subject to any disclaimer, the term of this patent is extended or adjusted under 35 U.S.C. 154(b) by 0 days.

(21) Appl. No.: 09/498,731

(22) Filed: Feb. 1, 2000

Related U.S. Application Data

(60) Provisional application No. 60/118,538, filed on Feb. 4, 1999.

(51) Int. Cl.[7] ..... B65D 71/00
(52) U.S. Cl. ..... 206/427; 206/203; 206/433
(58) Field of Search ..... 206/203, 427, 206/433, 588, 592, 594

(56) References Cited

U.S. PATENT DOCUMENTS 4,911,300 * 3/1990 Colonna ..... 206/427
5,377,862 * 1/1995 Oakes et al. ..... 220/513
5,826,712 * 10/1998 Aikio ..... 206/203

* cited by examiner

*Primary Examiner*—David T. Fidei
(74) *Attorney, Agent, or Firm*—Shlesinger, Arkwright & Garvey, LLB

(57) ABSTRACT

A package for shipping wine bottles vertically upright. A tray is provided for the bottom of a corrugated box to receive the bottoms of bottles and a protector is provided to engage and hold the bottle necks. Both the tray and protector are formed of molded pulp. The bottles are clamped between the bottom and top of the box and held against lateral movement relative to the box by engagement of the tray and protector with the walls of the box.

16 Claims, 2 Drawing Sheets

WINE BOTTLE PACKAGE

RELATED APPLICATION

This application claims the benefit of U.S. Provisional Application Ser. No. 60/118,538 filed Feb. 4, 1999.

FIELD OF INVENTION

The present invention relates to packaging, and more particularly to a package for wine bottles so that bottles are protected and securely held when the package is shipped.

BACKGROUND OF INVENTION

With the growth of the Internet, more and more wine is being ordered via personal computers. The wine ordered needs to be placed in a package for shipment, generally in a corrugated box. The wine bottles are positioned vertically. Within the box, each bottle needs to be supported at its bottom end spaced from the bottom of the box in a position which secures the bottle against movement laterally. The upper end of each bottle also needs to be held so that movement is prevented. The plurality of bottles have to be secured against moving relative to each other and against movement relative to the box in which they are positioned.

SUMMARY OF INVENTION

One object of this invention is to provide a package for wine bottles wherein a support tray in a box carries the wine bottles on the bottom of a box and a one-piece protector engages the neck of each bottle, the tray and protector being formed from molded pulp having side edges which conform with and engage the insides of the box.

Another object of the invention is to provide a molded pulp tray having a pocket for the bottom end of each wine bottle, each pocket spacing the bottom of the bottle from the box bottom and the tray being flexible whereby the bottom of the bottle may be wedged into the pocket to secure it in place.

Another object of the invention is to provide a molded pulp protector at the top of the package having a conical collar for the neck end of each bottle, each collar having one end engagable with the sloped surface between the body and neck of the bottle and an upper end extending above the top of the wine bottle and having internal flutes engaging the bottle neck.

A further object of this invention is to provide wine bottle support blanks of molded pulp having score lines whereby the blanks may be broken apart to accommodate the number of bottles to be placed in one box.

Other objects of the invention will be apparent hereinafter from the specification and the appended claims.

DESCRIPTION OF INVENTION

Figure 1:
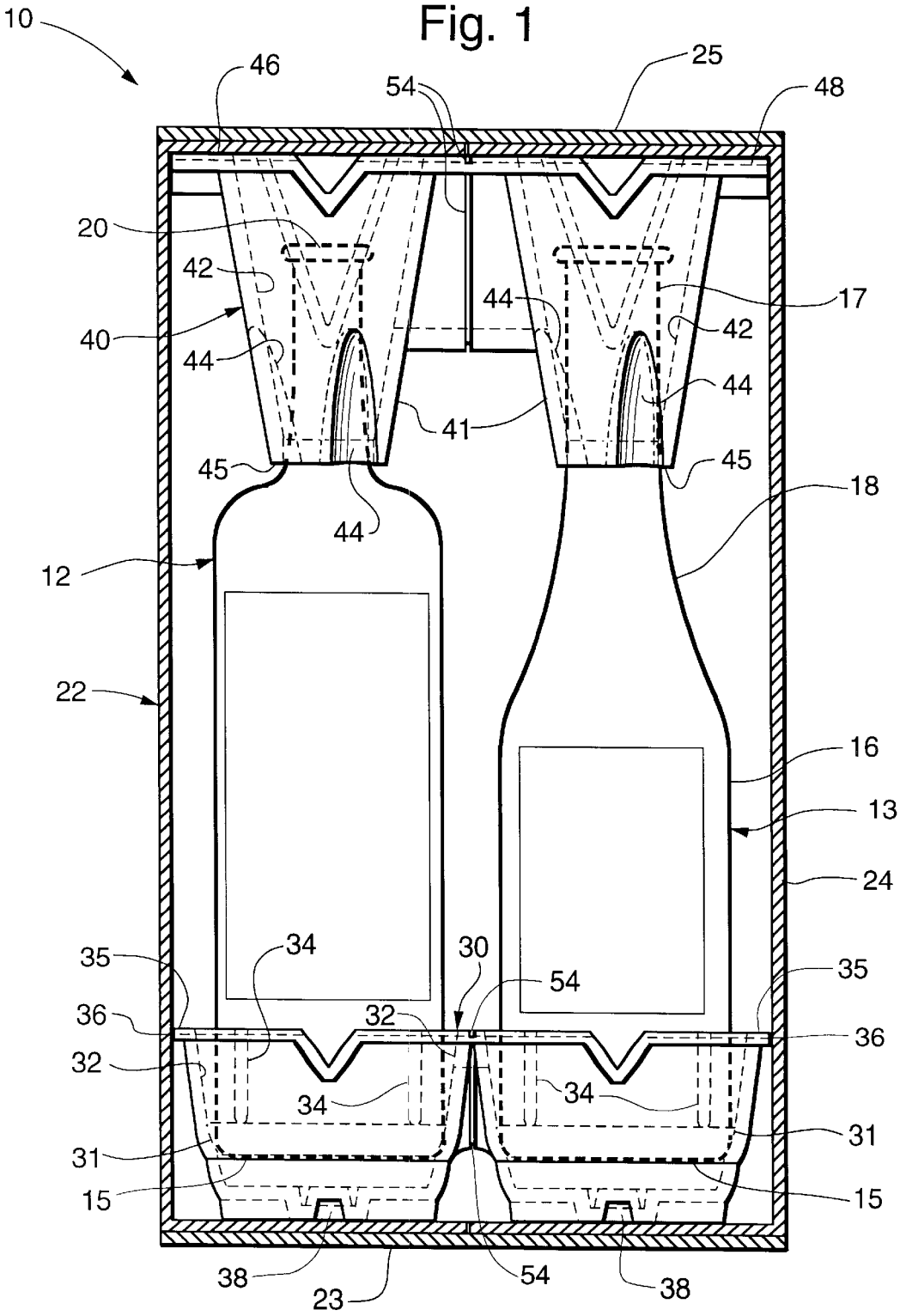
FIG. 1 is vertical section of a box for two wine bottles of different shapes, the bottles being secured and held in place by a bottom tray and top protector constructed according to this invention.
Figure 2:
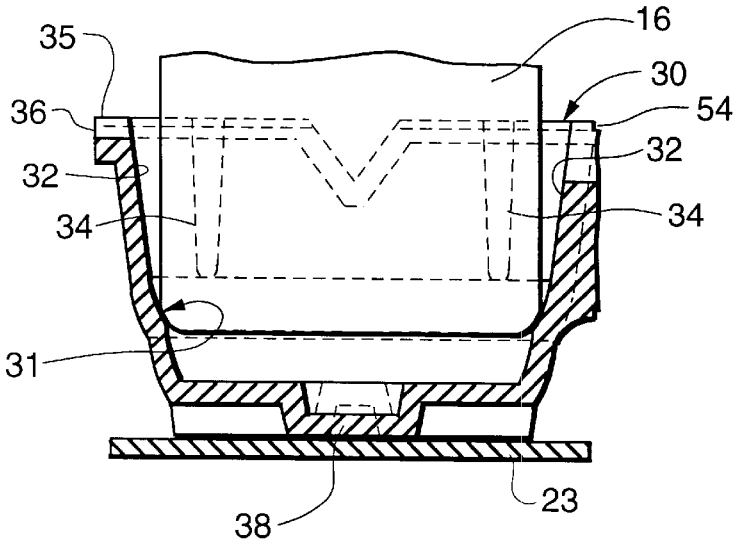
FIG. 2 is an enlarged cross section of bottom tray for the bottom end of one of the wine bottles.

Referring now to the drawing by numerals of reference, 10 denotes generally a package for wine bottles. Two differently shaped bottles are shown at 12 and 13. Each wine bottle has a wide bottom 15, a cylindrical body 16, and a neck 17 which connects to body 16 by a sloped section 18. Each bottle has a top end 20.

Wine bottles to be shipped are placed in a box 22 of corrugated paper or other material. The box has a bottom 23, sides 24 and top 25.

A one piece molded pulp tray 30 is provided to support the bottom ends 15 of the bottles. Tray 30 rests on the bottom 23 of box 22. It has two pockets 31, each to receive a bottle end. Each pocket has a sloped side 32. The molded pulp has resiliency. The size of the pocket is such that when the wine bottle is pressed into the pocket, it wedges therein to hold the bottle in place. Flutes or ribs 34 are provided in the pocket to increase the grip of tray 30 on the bottle.

Tray 30 has horizontal flanges 35 providing an area of the tray and side edges 36 which engage the inside walls of sides 24 of the box. The molded pulp tray has pads 38 which space the bottle bottom 15 from the bottom 23 of the box. The bottle is resiliently supported on the box bottom and is cushioned by tray 30.

Figure 3:
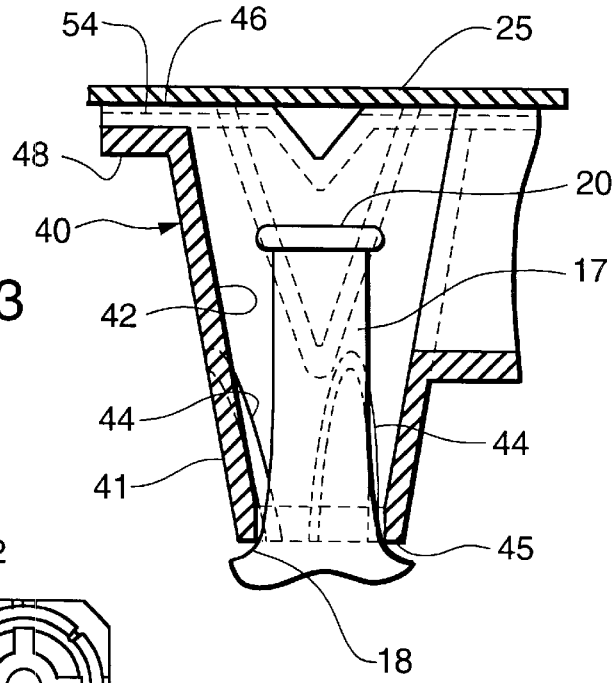
FIG. 3 is an enlarged cross section of the top protector for the neck end of one of the wine bottles.

At the top of the package, the bottles are held by a molded pulp protector 40, FIGS. 1 and 3. Each protector is in the form of a truncated cone or collar 41 wide at the top and narrow at the bottom. Cone 41 has a core 42 of such diameter that the cone may be slid over bottle neck 17. Inside the cone 41 are flutes or ribs 44 which engage the periphery of bottle neck 17 to help secure protector 40 in place.

Cone 41 has a lower edge 45 which engages and seats on the sloped portion 18 between the bottle body 16 and neck 17. The axial length of core 42 is such that edge 45 of the cone 41 engages the bottle with the top 20 of the bottle below the upper surface 46 of protector 40.

Like tray 30, protector 40 has horizontal flange portions 48. An area is formed having edges which engage sides 24 of the corrugated box. Further, the box is of such size that the top 25 of the box 22 engages the upper surface 46 of protector 40 whereby the bottles in the box are clamped vertically between tray 30 and protector 40. The bottles are secured from lateral movement in box 22 by the engagement of the flange portions 35 and 48 of tray 30 and protector 40, respectively, abutting against the box sides 24.

Figure 4:
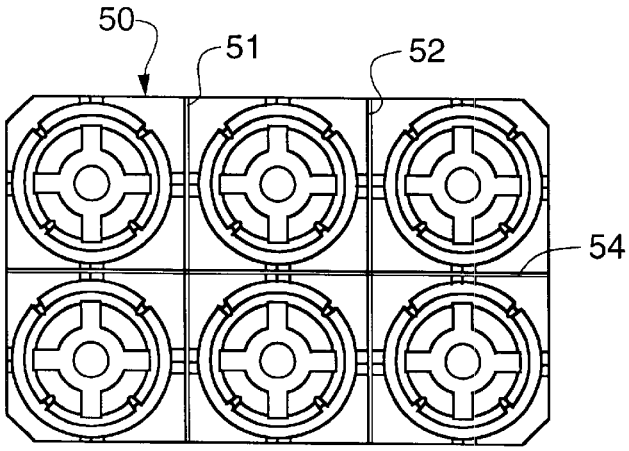
FIG. 4 is a plan view of one of molded pulp blanks for six bottles and showing score lines whereby the sections can be broken apart according to the number of wine bottles to be packaged.

As shown in FIG. 4, bottom 30 and top protector 40 are preferably molded in a one-piece rectangular configuration 50 to receive and support six bottles. Entire blanks are used when six bottles are to be packaged. Score lines are provided at 51 and 52, to form bottle sections whereby, one section can be bent and separated from another section, when a lesser number of bottles are to be packaged. For example, if two bottles are to be shipped, one section would be broken off. A two bottle box would be used. Then the bottles would be packaged as shown in FIG. 1.

If desired, a longitudinal score line 54 can also be provided so that a section for two bottles can be broken apart again for one bottle. Further, larger molded blanks can be manufactured where the number of bottles to be shipped exceeds six.

With this package design, wine bottles can be shipped where the bottles are spaced from each other and secured from movement in the box in which they are placed. Molded paper pulp provides resiliency to cushion the bottles when they are in the box, the bottles being clamped vertically between the tray 30 at the bottom and protector 40 at the top and secured from lateral movement by the molded pulp sections having flanges which engage the inside walls of the box.

As shown in FIG. 1 the wine package of this invention can hold bottles of different shapes. Further, when a bottle is to be shipped with a neck that is tapered from a narrow top to a wider bottom the top protector 40 can be placed in the box upside down. In that position, the wide part of the cone 41 would be down and the narrow end up. In either position, the edges 48 of the protector flange engage the inside walls of the box.

While this invention has been described in connection with a specific embodiment thereof, it will be understood that the design can be further modified while keeping within the scope of the invention and the appended claims.

Having thus described my invention what I claim is:

1. A package for bottles where the bottles are supported vertically and placed in a rectangular box having bottom, top and side walls, the bottles each including a bottom portion and a neck portion, said package comprising:

a) a tray of molded pulp for being positioned in the box on the bottom wall thereof;

b) said tray having pockets for receiving the bottom portion of each bottle spaced apart from the bottom wall of the box;

c) a protector of molded pulp positioned against the top wall of the box;

d) said protector having a truncated cone for forming a collar for each bottle and each cone having a central core for receiving the neck portion of the respective bottle spaced apart from the adjacent bottle;

e) said cone having a lower edge for seating on and engaging the neck portion of the respective bottle; and f) the depth of the core being such that the neck portion is below a top surface of the protector.

2. A package as recited in claim 1 wherein said tray and said protector each have flange portions for engaging the side walls of the box to hold the bottles against lateral movement relative to the box.

3. A package as recited in claim 1 wherein said core of each cone includes flutes for yieldably engaging the neck portion of the respective bottle.

4. A package as recited in claim 1 wherein said core of each cone is adapted to hold a top end of the neck of the respective bottle below said top surface of said protector.

5. A package as recited in claim 1 wherein each pocket in said tray has a downwardly and inwardly sloped wall including flutes for resiliently engaging the bottom portion of the respective bottle.

6. A package as recited in claim 1 where said tray and said protector are each molded in one piece.

7. A package as recited in claim 1 wherein said tray and protector are molded in horizontal blanks having score lines which divide each of said tray and said protector into sections which can be manually broken apart to accommodate the number of bottles to be packaged.

8. A package for bottles each including a bottom portion and a neck portion, comprising:

a) a rectangular box having bottom, top and side walls;

b) a tray of molded pulp positioned in the box on said bottom wall;

c) said tray having pockets for receiving the bottom portion of each bottle spaced apart from said bottom wall;

d) a protector of molded pulp positioned against said top wall for spacing the neck portion of each bottle from the adjacent bottle and from said top wall;

e) said protector having a truncated cone forming a collar for each bottle and each cone having a central core to receive the neck portion of the respective bottle;

f) said cone having a lower edge for seating on and engaging the neck portion of the respective bottle; and g) the depth of said core being such that the neck portion of each bottle is below a top surface of said protector.

9. A package recited as in claim 8 wherein said tray is seated on said bottom wall and said top surface of said protector is engaged by said top wall when the package is closed whereby bottles in the package are clamped between said top and bottom walls.

10. A package as recited in claim 8 wherein said protector is placed on the wine bottles with a wide portion of said cone directed towards the bottle and a narrow portion of said cone directed towards said top wall.

11. A package as recited in claim 8 wherein said tray and said protector each have flange portions for engaging the side walls of the box to hold the bottles against lateral movement relative to the box.

12. A package as recited in claim 8 wherein said core of each cone includes flutes for yieldably engaging the neck portion of the respective bottle to hold the bottle from movement within said box.

13. A package as recited in claim 8 wherein said core of each cone is adapted to hold a top end of the neck of the respective bottle below said top surface of said protector.

14. A package as recited in claim 8 wherein each pocket in said tray has a downwardly and inwardly sloped wall including flutes for resiliently engaging the bottom portion of the respective bottle.

15. A package as recited in claim 8 where said tray and said protector are each molded in one piece.

16. A package as recited in claim 8 wherein said tray and protector each are molded in horizontal blanks having score lines which divide each of said tray and said protector into sections which can be manually broken apart to accommodate the number of bottles to be packaged.

* * * * *